United States Patent [19]

Tominaga et al.

[11] Patent Number: 4,537,644

[45] Date of Patent: Aug. 27, 1985

[54] HIGH-TENSION HIGH-TOUGHNESS STEEL HAVING EXCELLENT RESISTANCE TO DELAYED FRACTURE AND METHOD FOR PRODUCING THE SAME

[75] Inventors: Jiro Tominaga, Hikari; Hiroshi Yada; Mitsuo Honda, both of Kitakyushu, all of Japan

[73] Assignee: Nippon Steel Corporation, Tokyo, Japan

[21] Appl. No.: 420,685

[22] Filed: Sep. 21, 1982

[30] Foreign Application Priority Data

Sep. 28, 1981 [JP] Japan ..... 56-153484

[51] Int. Cl.[3] ..... C22C 38/14; C22C 38/28; C22C 38/32

[52] U.S. Cl. ..... 148/36; 148/144; 75/123 B; 75/126 D; 75/126 P

[58] Field of Search ..... 75/126 D, 126 P, 123 B, 75/123 M; 148/12 B, 12.4, 36, 12 F, 144

[56] References Cited

U.S. PATENT DOCUMENTS

| | | | |
|---|---|---|---|
| 2,858,206 | 10/1958 | Boyce | 75/126 P |
| 3,251,682 | 5/1966 | Wada | 75/126 P |
| 3,574,602 | 4/1971 | Gondo et al. | 75/126 P |
| 3,617,230 | 11/1971 | Richards et al. | 75/123 B |
| 3,664,830 | 5/1972 | Kambayashi et al. | 148/36 |

FOREIGN PATENT DOCUMENTS

| | | | |
|---|---|---|---|
| 6221 | 1/1978 | Japan | 148/12 B |
| 65213 | 6/1978 | Japan . | |
| 65115 | 5/1979 | Japan | 75/123 B |
| 251 | 1/1981 | Japan | 148/12 F |
| 33425 | 4/1981 | Japan | 148/12 F |
| 69352 | 6/1981 | Japan | 75/123 M |

*Primary Examiner*—Peter K. Skiff

*Attorney, Agent, or Firm*—Pollock, Vande Sande & Priddy

[57] ABSTRACT

A high-tension high-toughness steel excellent in resistance to delayed fracture which consists essentially of 0.15 to 0.50% of C, up to 1.50% of Si, 0.20 to 1.50% of Mn, up to 2.00% of Cr, 0.0005 to 0.0030% of B, 0.005 to 0.10% of acid-soluble Al, up to 0.010% of P, up to 0.0020% of N, 0.010 to 0.050% of Ti and the balance iron and inevitable impurities, and has a tempered martensitic structure obtained by quenching and tempering.

17 Claims, 3 Drawing Figures

Figure 1:
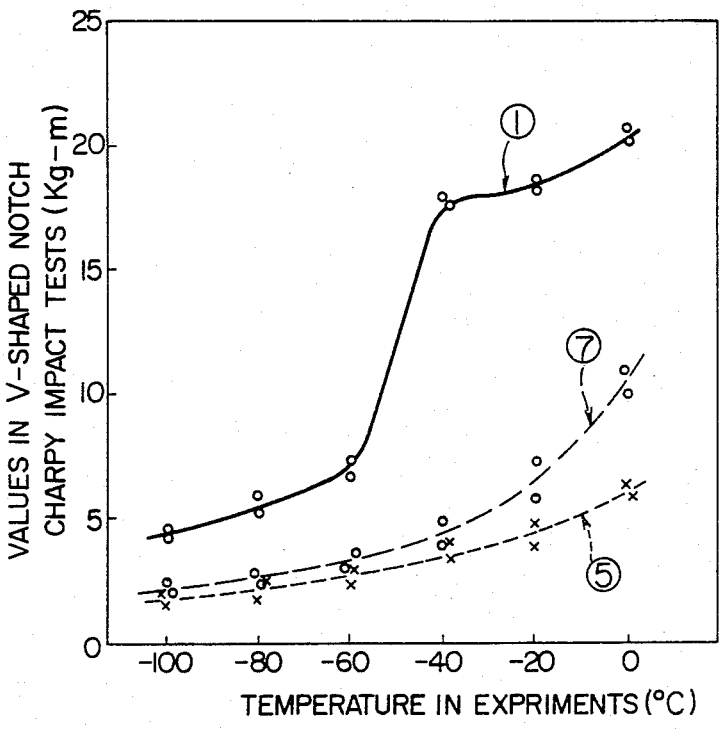

HIGH-TENSION HIGH-TOUGHNESS STEEL HAVING EXCELLENT RESISTANCE TO DELAYED FRACTURE AND METHOD FOR PRODUCING THE SAME

This invention relates to a high-tension high-toughness steel excellent in delayed fracture resistance, and to a method of producing the same.

With the increase in the size of huge steel structures in recent years, steels of further higher strength have been demanded. In U.S. Pat. No. 3,617,230 there is disclosed a high-tension steel wire having compositions similar to those of eutectoid steel in which steel wire all of phosphorous, sulfur and nitrogen included therein are reduced in amount to improve the elongation and cold workability thereof. However, in the U.S. Pat. No. 3,617,230 there is no description or suggestion regarding the improvement in resistance to delayed fracture. Hitherto, in conventional high tensile strength steels, there have been experienced frequently the occurrence of so-called "delayed fracture" in which the steels having been used in a natural environment has abruptly and statically comes to brittle fracture. Due to the delayed fracture problem, the application of conventional high-tension steels has significantly been limited.

It is one object of this invention to provide a high-tension high-toughness steel having a tensile strength of at least 100 kg/mm$^2$ and excellent resistance to delayed fracture, and a method for producing the same.

The high-tension high toughness steel according to the invention consists essentially of, by weight, 0.15 to 0.50% of C, up to 1.50% of Si, 0.2 to 1.50% of Mn, up to 2.00% of Cr, 0.0005 to 0.0030% of B, 0.005 to 0.100% of acid-soluble Al (Al solid-soluted in iron matrix without converting into compound such as $Al_2O_3$), up to 0.010% of P, up to 0.0020% of N, 0.010 to 0.050% of Ti and the balance of iron and inevitable impurities, and is characterized by having a quenched and tempered structure and excellent resistance to delayed fracture.

The method of producing the high-tension high-toughness steel according to the invention comprises the steps of austenitizing a steel containing, by weight, 0.15 to 0.50% of C, up to 1.50% of Si, 0.2 to 1.50% of Mn, up to 2.00% of Cr, 0.0005 to 0.0030% of B, 0.005 to 0.100% of acid-soluble Al, up to 0.010% of P, up to 0.020% of N, 0.010 to 0.050% of Ti and the balance of iron and inevitable impurities, at a temperature higher than the $A_3$ transformation point by 30° to 80° C., quenching the thus austenitized steel in water, oil or a salt bath, and subsequently tempering the steel at a temperature of 200°–500° C. not higher than the A, transformation point.

In this invention, the steel may further contain at least one member selected from the group consisting of up to 0.50% of Mo, up to 0.20% of V, up to 0.10% of Nb and up to 0.50% of Cu, in addition to the basic allowing components which consist of 0.15 to 0.50% of C, up to 1.50% of Si, 0.20 to 1.50% of Mn, up to 2.00% of Cr, 0.0005 to 0.0030% of B, 0.005 to 0.10% of acid-soluble Al, up to 0.0010% of P, up to 0.0020% of N and 0.010 to 0.050% of Ti.

The present inventor has discovered that it is possible to achieve a remarkable improvement in delayed fracture properties of a high-tension high-toughness steel by reducing the amounts of P and N both of which are apt to be significantly segregated at grain boundaries to degrade the boundary strength, and adding an appropriate amount of Ti and then subjecting the steel to a heat treatment according to the above described method of this invention to restrict the crystal grain growth.

The constituents of the steel according to the invention are adopted within the respectively specified limits for the following reasons.

Carbon is added to afford the required strength and hardenability to a steel, but the intended strength cannot be obtained when carbon content is less than 0.15% by weight. On the other hand, more than 0.50% of carbon will reduce the resistance to delayed fracture and will cause an adverse effect on workability. Therefore, 0.50% carbon is the upper limit.

Although Si is a necessary element for enhancing the strength of a steel, it causes a marked reduction in toughness when used in an amount of more than 1.50%.

Manganese is effective to increase hardenability as well as deoxidation, and the addition of at least 0.20% of Mn is necessary for attaining the effects. However, with more than 1.50% of Mn, both the delayed fracture resistance and notch toughness are deteriorated.

Addition of Cr is intended to enhance strength and hardenability, but the addition of Cr in excess of 2.00% will lead to a decrease in toughness.

The addition of B, in a tiny amount, is also effective in improving hardenability. However, the effect is insufficient at addition levels of below 0.0005% and, on the other hand, the effect is not varied significantly when the amount of B is increased above 0.0030%. Accordingly, B content is set to be 0.0005 to 0.0030%.

Al is added to steels not only as a deoxidizing agent but also for the purpose of fixing nitrogen and oxygen in the steels. The addition of this component should be limited to 0.005 to 0.10% of acid soluble Al, since above this limit, toughness of steel is markedly reduced.

P, N and Ti are critical alloying elements of the steel according to this invention.

Both P and N tend to segregate significantly at grain boundaries in a steel, thereby lowering the grain boundary strength of the steel with the result of a considerable reduction in delayed fracture resistance. Therefore, P and N contents are limited to 0.010% and 0.0020%, respectively, at maximum.

Ti is added in an amount of 0.010 to 0.050% for grain-refining purpose. Although a reduction in N content is effective in improving the delayed fracture resistance, this reduction causes the coarsening of grains because of the accompanying decrease of the amount of AlN to be formed in a steel, so that the delayed fracture resistance of the steel is seriously damaged, as shown in the examples below. Thus, at least 0.10% of Ti should be added to attain the grain refining effect. However, more than 0.050% of Ti results in a reduction in notch toughness because of excessive precipitation of titanium carbonitride. Therefore, the addition of Ti must not be in excess of 0.050%.

Other than the elements described above, at least one member selected from the group consisting of up to 0.50% of Mo, up to 0.20% of V, up to 0.10% of Nb and up to 0.50% of Cu are added, if necessary, for the purpose of increasing strength, improving hardenability or refining crystal grains. The upper limits for these elements have been determined from an economical point of view, based on the matter that the effects of these elements are saturated when the elements are used in amounts exceeding the respective limits.

Figure 2:
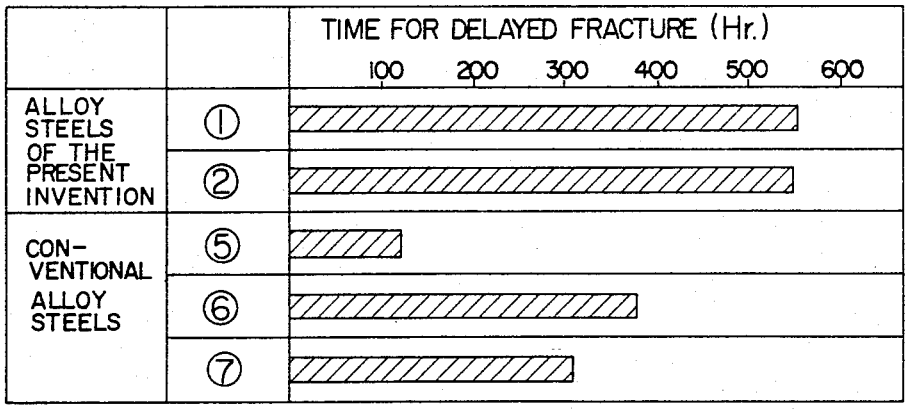
Figure 3:
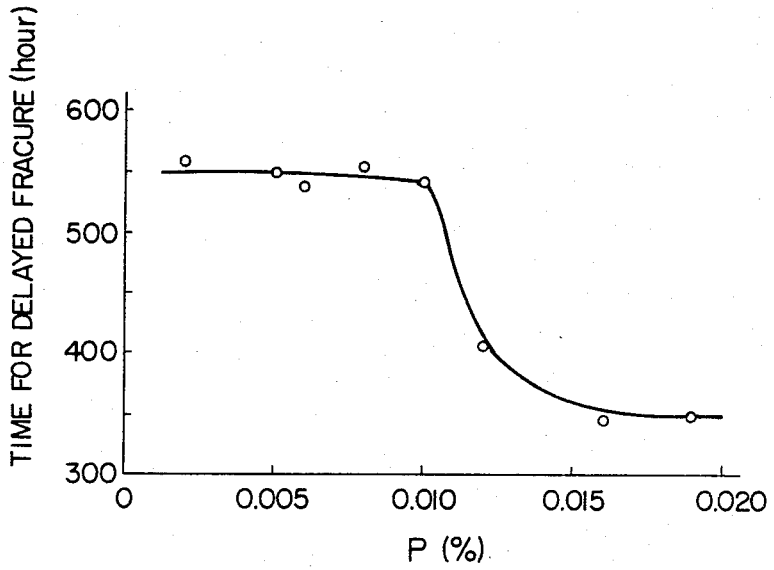

Other objects and features of this invention will become clear from the following detailed description, referring to the accompanied drawings, wherein:

FIG. 1 is a diagram which shows impact-transition curves for 2-mm V-notched Charpy impact test specimens, FIG. 2 being a diagram which shows periods of time required for notched round bar specimens to come to delayed fracture in a solution of pH 3.5, and FIG. 3 is a diagram showing relation between delayed fracture resistivity and phosphorus content in steel.

This invention will be described more in detail in connection with the following examples.

Table 1 shows the chemical compositions of the steels used in the examples, wherein steels Nos. 1 to 4 are ones according to this invention and steels Nos. 5 to 9 are of the prior art.

TABLE 1

| Kind | No | C | Si | Mn | P | S | Cr | Mo | V | Nb | Cu | Ti | B | Al | N |
|---|---|---|---|---|---|---|---|---|---|---|---|---|---|---|---|
| Steels of | 1 | 0.20 | 0.17 | 0.72 | 0.005 | 0.008 | 0.71 | | | | | 0.016 | 0.0014 | 0.029 | 0.0009 |
| the present | 2 | 0.19 | 0.18 | 0.73 | 0.010 | 0.007 | 0.74 | | | | | 0.021 | 0.0012 | 0.038 | 0.0011 |
| Invention | 3 | 0.32 | 0.23 | 0.82 | 0.008 | 0.010 | 0.95 | 0.17 | 0.08 | | | 0.033 | 0.0021 | 0.023 | 0.0016 |
| | 4 | 0.37 | 0.40 | 0.75 | 0.007 | 0.005 | 0.64 | | | 0.05 | 0.30 | 0.025 | 0.0016 | 0.027 | 0.0013 |
| Conventional | 5 | 0.19 | 0.17 | 0.75 | 0.003 | 0.002 | 0.74 | | | | | 0.005 | 0.0012 | 0.040 | 0.0010 |
| Steels | 6 | 0.21 | 0.20 | 0.70 | 0.018 | 0.012 | 0.76 | | | | | 0.017 | 0.0013 | 0.043 | 0.0026 |
| | 7 | 0.20 | 0.16 | 0.71 | 0.010 | 0.005 | 0.73 | | | | | 0.018 | 0.0015 | 0.027 | 0.0031 |
| | 8 | 0.34 | 0.31 | 0.93 | 0.023 | 0.004 | 0.88 | 0.21 | 0.07 | | | 0.018 | 0.0016 | 0.034 | 0.0021 |
| | 9 | 0.36 | 0.33 | 0.74 | 0.009 | 0.012 | 0.65 | | | 0.07 | 0.25 | 0.004 | 0.0023 | 0.046 | 0.0008 |

Table 2 shows mechanical properties and austenite grain size numbers of the steels which were tested after heat treated in the conditions shown therein. The results shown in Table 2 and FIG. 1 indicate clearly that the steel of this invention is much superior to prior art steels with respect to ductility and toughness in notch tests.

FIG. 2 shows an example of the results of delayed fracture tests which were conducted in a buffer solution (1.59% sodium acetate aqueous solution to which HCl is added to adjust the value of pH) of pH 3.5 by using the notched round bar tensile type delayed-fracture test specimens prepared from steels which had been quenched and tempered to have tensile strength of 117 to 119 kg/mm$^2$, each of which round bar specimens is provided with a diameter of 5 millimeters and a notched groove with a depth of 1 millimeter and a terminal radius of 0.06 millimeters, stress applied to each specimen was adjusted to such a value as 0.6×(tensile strength in atmosphere of the notched round bar tensile type delayed-fracture test specimen). As shown in FIG. 2, the time required for the rupture of the steel of this invention is longer than that for prior art steels, indicating the excellent delayed fracture resistance of the steel of this invention.

In Table 3 there are shown the results of experiments in which hexagon headed bolts each having a diameter of 22 mm and a length of 100 mm made of the steel of the present invention and prior art steels were obtained by tempering at 350° C. and 300° C. after the quenching thereof for the purpose of accelerate the phenomenon of the delayed fracture, with the tensile strength of the tempered bolts becoming 135 kg/mm$^2$ and 140 kg/mm$^2$ respectively, which bolts of five pieces per each steel number in Table 3 were fastened to a steel plate having thickness of 50 millimeters with nut turn angle of 240° and thus fastened bolts were left in a vessel having a temperature of 60° C. and relative humidity of not less than 95% for about 10 months period of time to observe the fracture thereof. The observation revealed the occurence of the delayed fracture regarding all the steel grades of the prior art. However, none of the specimens of the steels of the present invention showed the occurence of the delayed fracture, indicating excellent delayed fracture resistance of the present invention steels.

TABLE 2

| Kind | Number | Conditions in heat treatment: Quenching | Conditions in heat treatment: Tempering | Tensile* strength (kg/mm$^2$) | Proof stress (kg/mm$^2$) | Elongation (%) | Reduction of area (%) | Charpy** value at 0° C. (kg-m) | Transition*** temperature (°C.) | Austenite grain size number (ASTM No.) |
|---|---|---|---|---|---|---|---|---|---|---|
| Steels | ① | 880° C. | 420° C. | 117.2 | 109.1 | 18 | 67.7 | 20.5 | −50 | 7.4 |
| in the | ② | water | water | 117.4 | 108.7 | 17 | 66.9 | 17.0 | −42 | 8.0 |
| present | | quenching | quenching | | | | | | | |
| invention | ③ | 860° C. water quenching | 480° C. water quenching | 126.4 | 119.3 | 17 | 65.4 | 15.3 | −48 | 8.4 |
| | ④ | 860° C. oil quenching | 500° C. oil quenching | 120.2 | 114.6 | 18 | 66.2 | 16.7 | −40 | 7.7 |
| Prior art | ⑤ | 880° C. | 420° C. | 119.1 | 109.5 | 18 | 68.0 | 6.2 | +5 | 4.2 |
| steels | ⑥ | water | water | 118.0 | 107.7 | 17 | 64.2 | 12.4 | −34 | 7.2 |
| | ⑦ | quenching | quenching | 118.2 | 108.0 | 16 | 61.3 | 10.5 | −30 | 7.8 |
| | ⑧ | 860° C. water quenching | 480° C. water quenching | 127.8 | 120.4 | 15 | 63.0 | 10.8 | −24 | 8.0 |
| | ⑨ | 860° C. oil quenching | 500° C. oil quenching | 120.5 | 112.0 | 16 | 64.7 | 7.3 | −5 | 4.5 |

*In the tensile strength tests, JIS No. 4 test pieces each having a parallel portion of 14 mm in diameter and a gauge length of 50 mm were used.
**In Charpy impact test, JIS No. 4 Charpy impact test pieces each having a square section of 10 mm in one side, a length of 55 mm and a V-shaped notch of 2 mm in depth.
***Transition temperature is defined as a temperature at which a ductile fracture face and a brittle fracture face become 50% in ratio, respectively.

TABLE 3

| Kind | No. | Strength of bolt 135 kg/mm$^2$ | Strength of bolt 140 kg/mm$^2$ |
|---|---|---|---|
| Steel of the | 1 | 0/5* | 0/5* |
| present | 2 | 0/5 | 0/5 |
| invention | 3 | 0/5 | 0/5 |
| | 4 | 0/5 | 0/5 |

TABLE 3-continued

| Kind | No. | Strength of bolt 135 kg/mm² | Strength of bolt 140 kg/mm² |
|---|---|---|---|
| Conventional steels | 5 | 3/5 | 3/5 |
| | 6 | 0/5 | 2/5 |
| | 7 | 1/5 | 3/5 |
| | 8 | 0/5 | 3/5 |
| | 9 | 4/5 | 5/5 |

Test Conditions
Bolt size - 22 mm in diameter, 100 mm in length
Tightening - 240° in turn angle of nut
Exposure - 60° C. in temperature, not less than 95% in relative humidity in a tank
Period of time of tests - about 10 months
*Number of pieces of fracture/Number of pieces in test In all the examples, the prior art steels Nos. 5 and 9 contain P and N in the same compositional ranges as those in the case of the steel of this invention. However, because of lower Ti content, the steels Nos. 5 and 9 had suffered coarsening of crystal grains, which resulted in marked reduction in delayed fracture resistance and toughness.

Then, phosphorus content influence upon the delayed fracture is explained hereinbelow in detail. There were prepared delayed fracture specimens of the round notched bar type made of steels having such various phosphorus contents as shown in Table 4 thorugh the steps of quenching and tempering to thereby adjust the tensile strength of the specimens in a range of 118 to 120 kg/mm². The specimens were tested in a buffer solution of pH 3.5 to evaluate the resistance to delayed fracture thereof. The results of the experiment are shown in FIG. 3, wherein time for delayed fracture becomes extremely shortened when the content of phosphorus exceeds 0.010%, that is, the resistance to delayed fracture is very degraded in a case of phosphorus content exceeding 0.010%. Accordingly, the point of limiting the phosphorus content to a range not more than 0.010% is a significant feature of the present invention.

TABLE 4

| No. | C wt % | Si wt % | Mn wt % | P wt % | S wt % | Cr wt % | Ti wt % | B wt % | Al wt % | N wt % | Fe |
|---|---|---|---|---|---|---|---|---|---|---|---|
| 1 | 0.19 | 0.19 | 0.74 | 0.002 | 0.010 | 0.72 | 0.017 | 0.0017 | 0.031 | 0.0012 | Bal |
| 2 | 0.20 | 0.17 | 0.73 | 0.005 | 0.008 | 0.71 | 0.016 | 0.0014 | 0.029 | 0.0009 | Bal |
| 3 | 0.20 | 0.24 | 0.70 | 0.006 | 0.012 | 0.67 | 0.032 | 0.0020 | 0.023 | 0.0018 | Bal |
| 4 | 0.21 | 0.18 | 0.72 | 0.008 | 0.008 | 0.76 | 0.018 | 0.0013 | 0.034 | 0.0015 | Bal |
| 5 | 0.19 | 0.18 | 0.73 | 0.010 | 0.007 | 0.74 | 0.021 | 0.0012 | 0.038 | 0.0017 | Bal |
| 6 | 0.20 | 0.20 | 0.75 | 0.012 | 0.005 | 0.73 | 0.026 | 0.0015 | 0.026 | 0.0014 | Bal |
| 7 | 0.21 | 0.15 | 0.71 | 0.016 | 0.007 | 0.70 | 0.025 | 0.0021 | 0.040 | 0.0010 | Bal |
| 8 | 0.19 | 0.20 | 0.72 | 0.019 | 0.010 | 0.74 | 0.020 | 0.0013 | 0.033 | 0.0015 | Bal |

As has been stated, the high-tension steel of this invention has excellent delayed fracture resistance and toughness which had not been obtained with conventional steels. Accordingly, the steel of this invention are widely applicable to high-strength bolts, PC steel bars and other structural members where the delayed fracture problem is encountered.

What is claimed is:

1. A high tensile tension high-toughness steel excellent in resistance to delayed fracture, having a tempered martensitic structure obtained by quenching and tempering and having a tensile strength of at least 100 kg/mm² and consisting essentially, by weight, of 0.15 to 0.50% of C, up to 1.50% of Si, 0.20 to 1.50% of Mn, up to 2.00% of Cr, 0.0005 to 0.0030% of B, 0.005 to 0.10% of acid-soluble Al, up to 0.010% of P, up to 0.0020% of N, 0.010 to 0.050% of Ti and the balance iron and inevitable impurities.

2. A high-tension high-toughness steel excellent in resistance to delayed fracture, having a tempered martensitic structure obtained by quenching and tempering and having a tensile strength of at least 100 kg/mm² comprising the steps of preparing a steel consisting essentially, by weight, of 0.15 to 0.50% of C, up to 1.50% of Si, 0.20 to 1.50% of Mn, up to 2.00% of Cr, 0.0005 to 0.0030% of B, 0.005 to 0.10% of acid-soluble Al, up to 0.010% of P, up to 0.0020% of N, 0.010 to 0.050% of Ti and the balance iron and inevitable impurities, austenitizing said steel at a temperature of not lower than $A_3$ transformation point, quenching the thus austenitized steel in water, oil or a salt bath, and tempering the thus quenched steel at a temperature of not higher than $A_1$ transformation point.

3. A method for producing a high-tension high-toughness steel excellent in resistance to delayed fracture, and having a tensile strength of at least 100 Kg/mm² comprising the steps of preparing a steel consisting essentially, by weight, of 0.15 to 0.50% of C, up to 1.50% of Si, 0.20 to 1.50% of Mn, up to 2.00% of Cr, 0.0005 to 0.0030% of B, 0.005 to 0.10% of acid-soluble Al, up to 0.010% of P, up to 0.0020% of N, 0.010 to 0.050% of Ti and the balance iron and inevitable impurities, austenitizing said steel at a temperature of not lower than $A_3$ transformation point, quenching the thus austenitized steel in water, oil or a salt bath, and tempering the thus quenched steel at a temperature of not higher than $A_1$ transformation point.

4. A method for producing a high-tension high-toughness steel excellent in resistance to delayed fracture, and having a tensile strength of at least 100 kg/mm² comprising the steps of preparing a steel consisting essentially, by weight, of 0.15 to 0.50% of C, up to 1.50% of Si, 0.20 to 1.50% of Mn, up to 2.00% of Cr, 0.0005 to 0.0030% of B, 0.005 to 0.10% of acid-soluble Al, up to 0.010% of P, up to 0.0020% of N, 0.010 to 0.050% of Ti and at least one member selected form the group consisting of up to 0.50% of Mo, up to 0.20% of V, up to 0.10% of Nb and up to 0.50% of Cu, the balance being iron and inevitable impurities, austenitizing said steel at a temperature of not lower than $A_3$ transformation point, quenching the thus quenched steel in water, oil or a salt bath, and tempering the quenched steel at a temperature of not higher than $A_1$ transformation point.

5. The method according to claim 3 or 4, whrein the austenitizing temperature is in the range higher than the $A_3$ transformation point by 30° to 80° C., and the tempering temperature is in the range of 200° to 550° C. which is lower than the $A_1$ transformation point.

6. The steel of claim 1 which contains at least 0.0009% of N.

7. The steel of claim 6 which contains at least 0.002% of P.

8. The steel of claim 1 which contains at least 0.002% of P.

9. The steel of claim 2 which contains at least 0.0009% of N.

10. The steel of claim 9 which contains at least 0.002% of P.

11. The steel of claim 2 which contains at least 0.002% of P.

12. The method of claim 3 wherein said steel contains at least 0.0009% of N.

13. The method of claim 12 wherein said steel contains at least 0.002% of P.

14. The method of claim 3 wherein said steel contains at least 0.002% of P.

15. The method of claim 4 wherein said steel contains at least 0.0009% of N.

16. The method of claim 15 wherein said steel contains at least 0.002% of P.

17. The method of claim 4 wherein said steel contains at least 0.002% of P.

* * * * *